United States Patent [19]

Williams

[11] 3,987,582

[45] Oct. 26, 1976

[54] GRANDMOTHER WITH GRANDCHILD DOLL ON A STAND

[76] Inventor: Earnestine J. Williams, R.D. No. 2 4640 Middle Road, Horseheads, N.Y. 14845

[22] Filed: Sept. 29, 1975

[21] Appl. No.: 617,936

[52] U.S. Cl. ..... 46/116; 46/32; 248/175

[51] Int. Cl.[2] ..... F16M 11/16

[58] Field of Search ..... 46/32, 116, 153; 248/175, 441, 121

[56] References Cited

UNITED STATES PATENTS

| | | | |
|---|---|---|---|
| 569,333 | 10/1896 | Hinckley | 46/32 |
| 587,231 | 7/1897 | Parker | 248/175 X |
| 1,359,388 | 11/1920 | Koerner | 248/175 X |
| 1,431,482 | 10/1922 | Overholt | 46/153 |
| 1,753,032 | 4/1930 | Stein et al. | 46/116 UX |
| 2,527,152 | 10/1950 | Ransom et al. | 46/32 X |
| 3,516,632 | 6/1970 | Hall | 46/32 X |

*Primary Examiner*—F. Barry Shay
*Attorney, Agent, or Firm*—Richard L. Miller

[57] ABSTRACT

A new doll design in which a doll having the appearance of a grandmother holds a small doll in her arms and which represents a grandchild; the grandmother doll being supported in a standing position by a stand located underneath her skirt, the stand being formed into a wire clip having jaws between which the body of the grandmother doll is clamped, and the stand being adaptable to stand up on any horizontal surface.

1 Claim, 4 Drawing Figures

GRANDMOTHER WITH GRANDCHILD DOLL ON A STAND

This invention relates generally to toy dolls.

A principal object of the present invention is to provide a novel doll in which it holds a smaller doll so to represent an adult such as a grandmother holding a grandchild in her arms.

Another object is to provide a grandmother with grandchild doll which is supported upon a novel stand that is hidden from view underneath the doll so that it does not interfere with the doll appearance.

Yet another object is to provide a grandmother with grandchild doll on a stand which makes an attractive display as well as a pleasing toy, as preferred, and wherein the doll can be quickly and easily removed from the stand or replaced thereupon, so that it can be used for either purpose.

Other objects are to provide a grandmother with grandchild doll on a stand which is simple in design, inexpensive to manufacture, rugged in construction, easy to use and efficient in operation.

These and other objects will be readily evident upon a study of the following specification and the accompanying drawing wherein.

Figure 1:
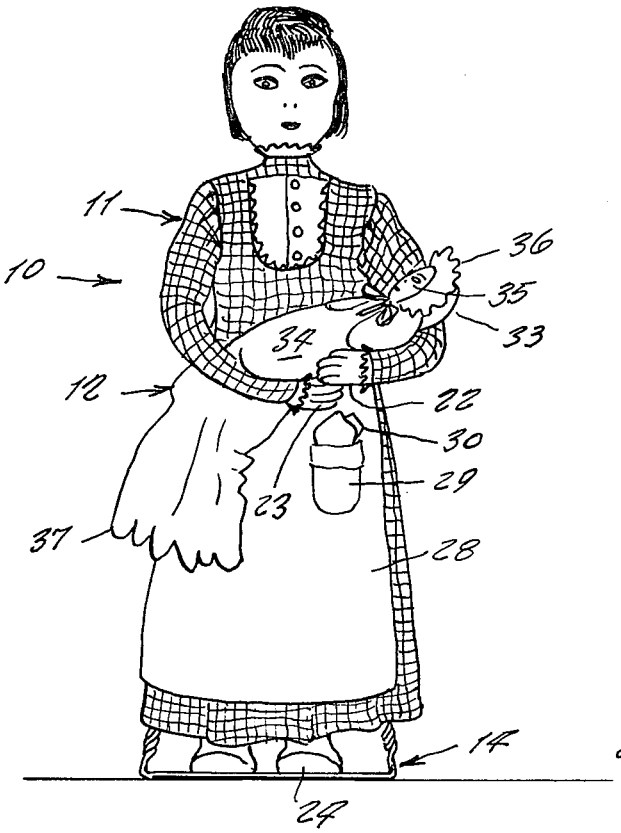
FIG. 1 is a front view of the doll.
Figure 2:
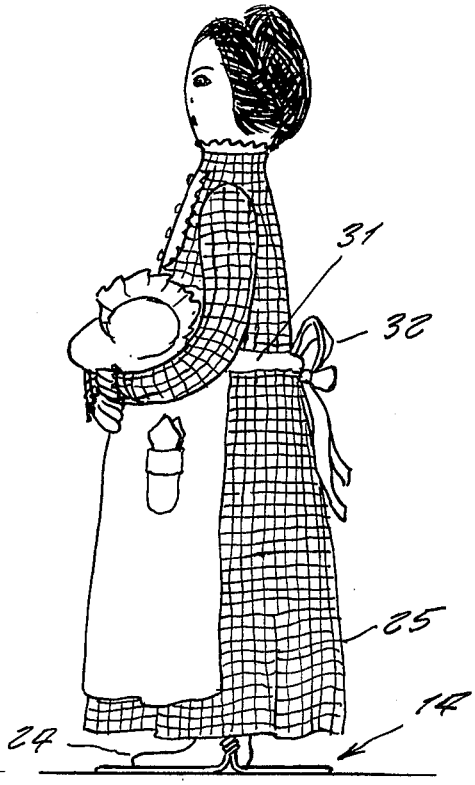
FIG. 2 is a side view thereof.

Referring now to the drawing in greater detail, the reference numeral 10 represents a doll unit according to the present invention wherein there is a relatively large upright doll 11 that represents a grandmother, and wherein there also is a relatively smaller doll 12 that is held by the grandmother doll and which represents accordingly a grandchild doll. This doll assembly 13 is supported upon a stand 14 in order that the same may be displayed in a lifelike manner.

The grandmother doll comprises a body 15 that may be of stuffed or other material, the body including a torso 16 a head 17, legs 18 and arms 19. The head includes a painted face 20 and either painted or applied fibers representing hair 21. The arms 19 includes hands 22 with fingers 23. The legs 18 include feet 24 at a lower end.

The grandmother doll is covered by clothing sewn of various fabrics in various attractive color, and include a dress 25 having a ruffled doily 26 in front and ruffled collar 27. An apron 28 has a pocket 29 containing a handkerchief 30, the apron being tied around the grandmother doll dress by means of apron strings 31 tied in a bow 32 behind.

The grandchild doll is shown including a head 33 and body 34. The head has a painted face 35 and the head is covered with a scalloped edged bonnet 36 while the body 34 is clothed in a long baby kimona 37.

Figure 3:
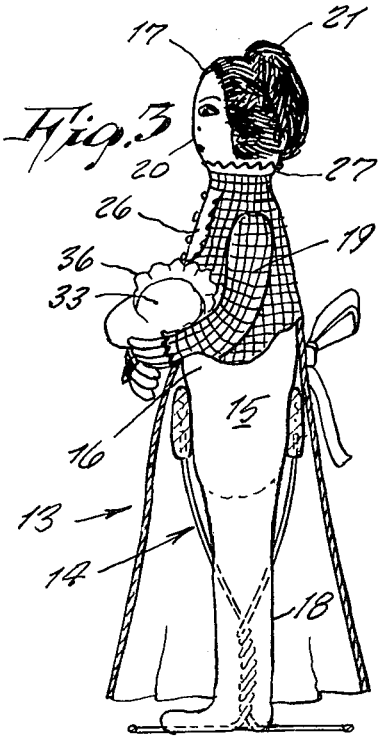
FIG. 3 is a side view shown partly in cross section so to illustrate the supporting stand underneath.
Figure 4:
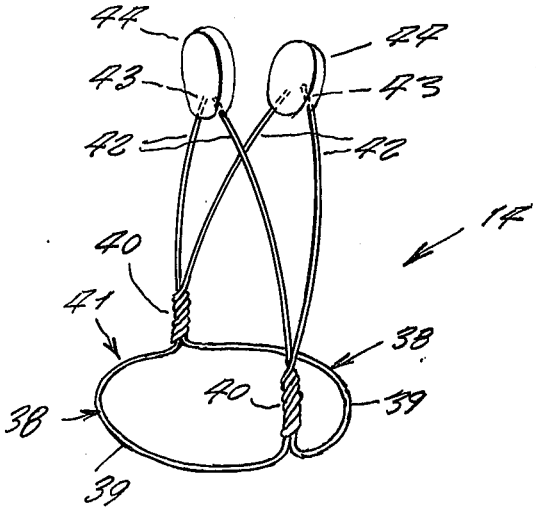
FIG. 4 is a perspective view of the stand shown alone.

The stand 14 is comprised of two spring steel wires 38, each of which at their longitudinal centers are bent into a semi circular loop 39 and then both wires are twisted together so to form twisted portions 40 at each end of the semi circular loops, it being noted that the semi circular loops are positioned so that together they form a circular loop 41 that forms a base of the stand and from which the twisted portions 40 extend upwardly parallel to each other. The opposite ends of each wire then extend upwardly from each twisted portion 40 in a converging manner so to form converging legs 42 which at their terminal upper ends 43 are secured by adhesive or other suitable means in a pad 44 made of covered fabric, rubber or the like. The pads serve as jaws that are urged toward each other by the spring steel wires, so that, as shown in FIG. 3, when the stand is placed under the skirt of the dress, the body of the grandmother doll can be clamped between the pads, so that the stand can support the doll upright.

While various changes may be made in the detail construction, it is understood that such changes will be within the spirit and scope of the present invention as is defined by the appended claims.

What is claimed is:

1. In a supported doll assembly, the combination of a doll unit consisting of an upright relatively larger doll representing a grandmother, and a relatively smaller doll representing a grandchild, said doll unit being supported in upstanding position on a stand slipped around a lower end of said grandmother doll in a hidden manner, wherein said grandmother doll includes a body with arms and legs, a head with face and hair, said grandchild doll includes a body and head with face, said grandchild doll being held in the arms of said grandmother doll; said grandmother doll being clothed in a dress, and apron, and said grandchild doll being clothed in a bonnet and kimona, wherein said stand comprises two spring steel wires each having at its longitudinal center a semi-circular loop, said loops being generally coplanar and positioned adjacent each other to form a circular loop, said wires being twisted together adjacent said circular loop so to form united twisted portions extending toward the same side of the plane of said circular loops, the ends of said wires extending upwardly and converging into two separate pairs, each said pair being joined to a respective pad, said grandmother doll body being grasped between said pads.

* * * * *